US009334604B1

(12) United States Patent
Li

(10) Patent No.: US 9,334,604 B1
(45) Date of Patent: May 10, 2016

(54) WATER FILL VALVE ASSEMBLY FOR AN IRON

(71) Applicant: Hamilton Beach Brands, Inc., Glen Allen, VA (US)

(72) Inventor: Wenbin Li, Shenzhen (CN)

(73) Assignee: Hamilton Beach Brands, Inc., Glen Allen, VA (US)

( * ) Notice: Subject to any disclaimer, the term of this patent is extended or adjusted under 35 U.S.C. 154(b) by 18 days.

(21) Appl. No.: 14/594,460

(22) Filed: Jan. 12, 2015

(51) Int. Cl.
*D06F 75/14* (2006.01)
*D06F 75/18* (2006.01)

(52) U.S. Cl.
CPC ..... *D06F 75/14* (2013.01); *D06F 75/18* (2013.01)

(58) Field of Classification Search
CPC ..... D06F 75/00; D06F 75/08–75/22; D06F 75/36; B65D 47/00
USPC ..... D32/70
See application file for complete search history.

(56) References Cited

U.S. PATENT DOCUMENTS 2,662,316 A * 12/1953 Johnson ..... D06F 75/14 38/77.81
2,680,312 A * 6/1954 Parr ..... D06F 75/14 38/77.83
3,811,208 A * 5/1974 Vieceli ..... D06F 75/14 38/77.8
3,949,499 A * 4/1976 Schaeffer ..... D06F 75/14 38/77.3
4,107,860 A * 8/1978 Coggiola ..... D06F 75/18 38/77.83
4,748,755 A * 6/1988 Bain, Jr. ..... D06F 75/14 219/245
5,408,769 A 4/1995 Patrick
5,414,945 A * 5/1995 Freeman ..... D06F 79/02 219/259
5,446,983 A 9/1995 Patrick
6,243,976 B1 6/2001 Beveraly et al.
6,389,717 B2 5/2002 Maier et al.
6,745,504 B2 * 6/2004 Sastre ..... D06F 75/14 38/77.82
6,807,755 B2 10/2004 Bontems et al.
D550,915 S 9/2007 Poon
7,546,701 B2 6/2009 Alipour
7,552,552 B1 6/2009 Garman et al.
D610,764 S 2/2010 Massip et al.
D624,266 S 9/2010 Massip et al.
D656,285 S 3/2012 Massip et al.
2013/0183174 A1 * 7/2013 Hampton ..... F04B 17/04 417/410.1

* cited by examiner

*Primary Examiner* — Ismael Izaguirre
(74) *Attorney, Agent, or Firm* — Alexander D. Raring

(57) ABSTRACT

An iron includes a housing having a sole plate on a base end thereof and a water reservoir therein, for receiving water therein. A water fill valve assembly is in fluid communication with the reservoir. The valve assembly includes a one way check valve having an open first end, an opposing expandable second end proximate the water reservoir, and a valve body extending therebetween. The second end of the check valve is normally in a first constricted configuration, substantially preventing water within the water reservoir from freely exiting therethrough, and is expandable by water poured into the open first end of the valve and flowing to the second end, such that the poured-in water substantially freely flows therethrough and into the water reservoir. The second end of the check valve returns to the first configuration after the poured in water has passed therethrough.

18 Claims, 5 Drawing Sheets

WATER FILL VALVE ASSEMBLY FOR AN IRON

BACKGROUND OF THE DISCLOSURE

The present disclosure is generally directed to an iron, and more particularly to a water fill valve assembly for a steam iron.

Irons are known for pressing and removing wrinkles from fabric. Many conventional household steam irons include a water reservoir therein for receiving and storing water to be selectively converted to steam during an ironing process, to assist in removal of wrinkles Water is typically introduced by a user into the water reservoir of the iron through a water fill assembly at the outer housing of the iron in fluid communication with the water reservoir.

In many irons, the water fill assembly includes an opening without a cover or other means to close the assembly. One drawback of such water fill assemblies is that normal movement of the iron during use may cause water in the water reservoir to slosh out through the exposed opening. Additionally, even if the water rarely actually sloshes out, consumers may incorrectly perceive that hot water could spill out through the opening and fear injury. During filling of the iron, it is also possible that water may not be fully retained in the iron fill port.

Therefore, it would be advantageous to provide an iron having a one-way water fill valve assembly in fluid communication with the water reservoir, allowing water to freely enter into the water reservoir therethrough, while preventing water within the water reservoir from exiting therethrough.

BRIEF SUMMARY OF THE DISCLOSURE

Briefly stated, one aspect of the present disclosure is directed to an iron comprising a housing having a sole plate on a base end of the housing and a water reservoir within the housing, for receiving water therein. A water fill valve assembly is in fluid communication with the water reservoir. The valve assembly includes a one way check valve having an open first end, an opposing expandable second end proximate the water reservoir, and a valve body extending therebetween. The second end of the check valve is normally in a first constricted configuration, substantially preventing water within the water reservoir from freely exiting therethrough, and is expandable by water poured into the open first end of the valve and flowing to the second end, such that the poured-in water substantially freely flows therethrough and into the water reservoir. The second end of the check valve returns to the first configuration after the poured in water has passed therethrough.

Another aspect of the present disclosure is directed to an iron comprising a housing having a sole plate on a base end of the housing and a water reservoir within the housing, for receiving water therein. A water fill valve assembly is in fluid communication with the water reservoir. The valve assembly includes an elastomeric duckbill valve having an open end, a pair of lips defining an opposing end thereof proximate the water reservoir, and a valve body extending therebetween. The lips are normally biased into sealing engagement with one another such that water within the water reservoir cannot freely flow through the valve assembly. Water poured into the open end of the valve assembly overcomes the bias of the lips and separates the lips from one another to freely flow into the water reservoir.

Another aspect of the present disclosure is directed to an iron comprising a housing having a sole plate on a base end of the housing and a water reservoir within the housing, for receiving water therein. A water fill valve assembly is in fluid communication with the water reservoir. The valve assembly includes a check valve having an open end, a generally semicircular orifice defining an opposing end thereof proximate the water reservoir, and a valve body extending therebetween. The generally semicircular orifice has a radius of less than or equal to about 3 mm in an initial configuration to substantially prevent water within the water reservoir from freely exiting through the orifice. The orifice is expandable by water poured into the open first end of the valve and flowing to the orifice, such that the poured-in water substantially freely flows therethrough and into the water reservoir. The orifice of the check valve returns to the initial configuration after the poured in water has passed therethrough.

BRIEF DESCRIPTION OF THE DRAWINGS

The foregoing summary, as well as the following detailed description of the disclosure, will be better understood when read in conjunction with the appended drawings. For the purpose of illustrating the disclosure, there are shown in the drawings preferred embodiments of an iron which are presently preferred. It should be understood, however, that the disclosure is not limited to the precise arrangements and instrumentalities shown. In the drawings.

DESCRIPTION OF THE DISCLOSURE

Figure 1:
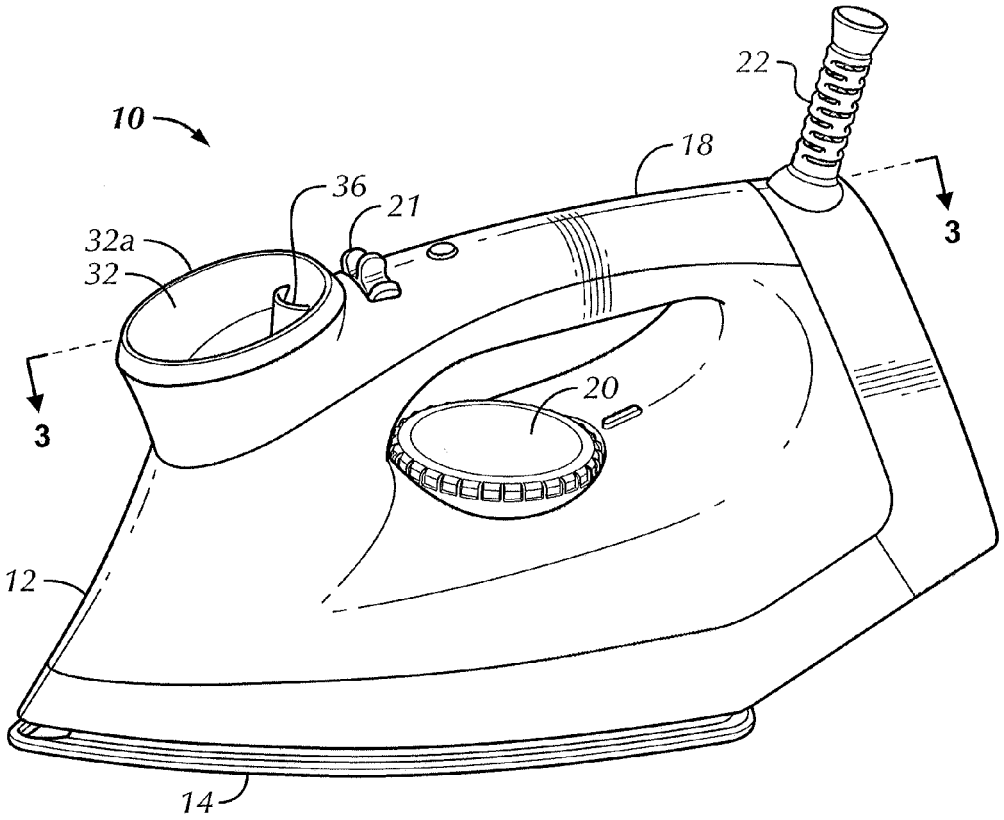
FIG. 1 is a perspective side view of a representative iron, with which preferred embodiments of the present disclosure is used.

Certain terminology is used in the following description for convenience only and is not limiting. The words "lower," "bottom," "upper" and "top" designate directions in the drawings to which reference is made. The words "inwardly," "outwardly," "upwardly" and "downwardly" refer to directions toward and away from, respectively, the geometric center of the iron, and designated parts thereof, in accordance with the present disclosure. Unless specifically set forth herein, the terms "a," "an" and "the" are not limited to one element, but instead should be read as meaning "at least one." The terminology includes the words noted above, derivatives thereof and words of similar import.

It should also be understood that the terms "about," "approximately," "generally," "substantially" and like terms, used herein when referring to a dimension or characteristic of a component of the disclosure, indicate that the described dimension/characteristic is not a strict boundary or parameter and does not exclude minor variations therefrom that are functionally the same or similar. At a minimum, such references that include a numerical parameter would include variations that, using mathematical and industrial principles accepted in the art (e.g., rounding, measurement or other systematic errors, manufacturing tolerances, etc.), would not vary the least significant digit.

Figure 2:
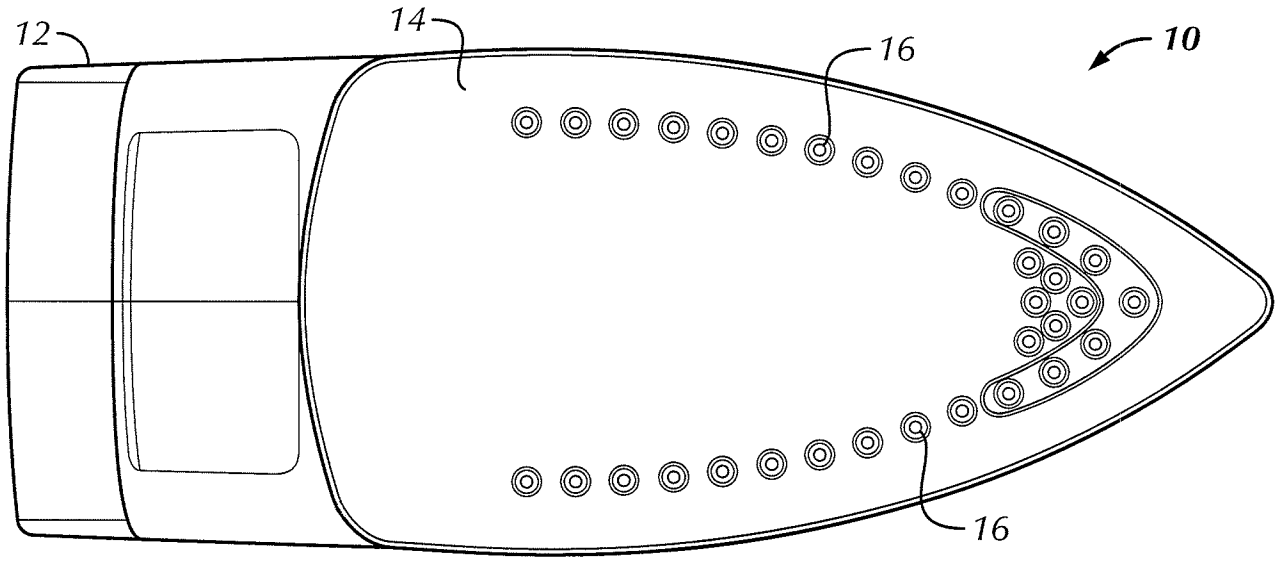
FIG. 2 is a bottom plan view of the iron of FIG. 1.
Figure 3:
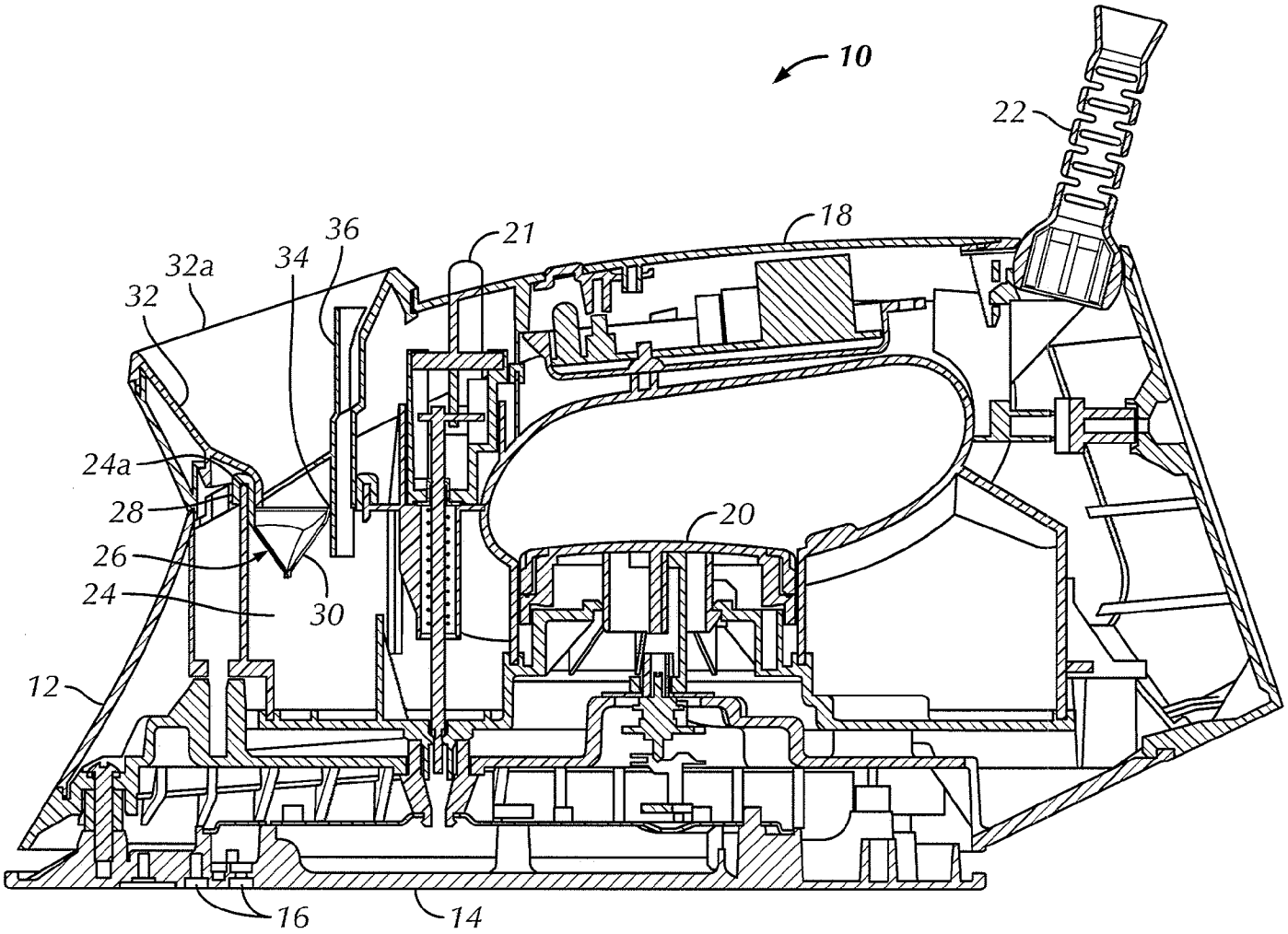
FIG. 3 is an cross-sectional elevational side view of the iron of FIG. 1, taken along sectional line 3-3, showing the water fill valve assembly according to one embodiment of the disclosure.

Referring to the drawings in detail, wherein like numerals indicate like elements throughout, there is shown in FIGS. 1-3 a representative iron, generally designated 10, with which preferred embodiments of the present disclosure may be used. As shown, the iron 10 includes a housing 12 and a sole plate 14 coupled to a base end thereof, as is conventionally known. The sole plate 14 includes a plurality of openings 16 (FIG. 2) distributed at spaced locations therein, to allow a flow of steam therethrough when the sole plate 14 is pressed against a garment, as is also conventionally known.

As should be understood by those of ordinary skill in the art, the housing 12 may be formed of multiple components and is preferably constructed of a heat insulating polymer or ceramic material. The sole plate 14 is preferably made from a metal, such as, for example, aluminum, stainless steel, or the like. The housing further includes a handle 18, at least a portion of which run generally parallel to the sole plate 14. For normal ironing operations, a user grasps the handle 18 and applies the sole plate 14 to a garment placed on an ironing board or other underlying support surface (not shown).

A heater (not shown) is provided in thermal communication with the sole plate 14 for ironing operations. A temperature control dial 20 is located on the housing 12 and allows the user to select a desired temperature, in a conventional manner well understood by those of ordinary skill in the art. In the illustrated embodiment, the temperature control dial 20 is a rotary dial and includes markings (not shown) that indicate the selected temperature. Markings may be provided in terms of, for example, the material of the garment to be ironed (e.g., cotton, polyester, or the like), color coding, numerals, or the like. A steam control knob 21 is located on the handle 18, and allows the user to select a desired flow of steam through the openings 16, in a conventional manner well understood by those of ordinary skill in the art. As should be understood by those of ordinary skill in the art, however, the iron may include other forms of temperature and steam control, as well as other control features, in the form of, e.g., a plurality of buttons or the like. A cord cover 22 protrudes from a rear of the housing 12, and accommodates a power cable (not shown) for providing electrical power to the iron 10 during operation. Other conventional features, such as indicator lights, grips, or the like (not shown) may also be used with the iron 10.

Referring to FIG. 3, a water reservoir 24, having an inlet 24*a* for receiving water (not shown) therethrough, is located within the housing 12 for storing water for use during steam iron or steaming operations. The iron 10 additionally includes a water fill valve assembly 26 located at the inlet 24*a* and in fluid communication with the water reservoir.

Figure 4A:
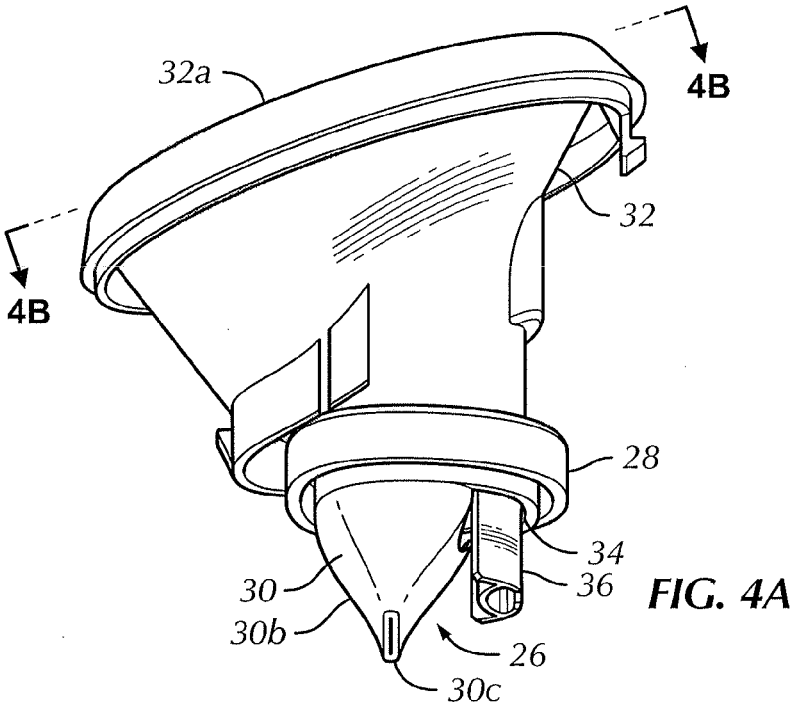
FIG. 4A is perspective side view of a first embodiment of a one way check valve of the fill valve assembly of the present disclosure.

As shown in FIGS. 4A-5B, the valve assembly 26 comprises an upper rim 28, proximate the surface of the housing 12, having a one-way check valve 30 extending therefrom into the water reservoir 24. In one embodiment, as shown in FIGS. 4A-4B, the one-way check valve 30 is a duckbill valve. An open first end 30*a* of the duckbill valve 30 is engaged with the upper rim 28, and a valve body 30*b* of the valve 30 projects toward and into the upper end of the water reservoir 24 from the upper rim 28 to a pair of lips 30*c* defining an opposing second end of the valve 30.

Figure 4B:
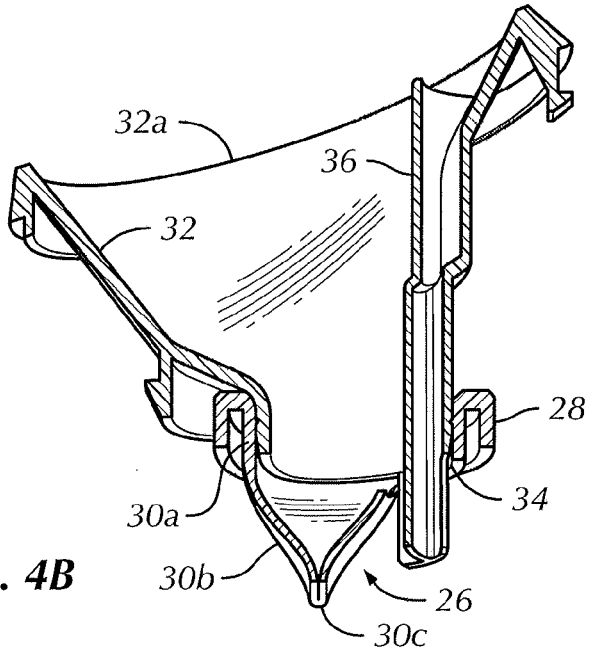
FIG. 4B is a cross-sectional perspective side view of the one way check valve of FIG. 4A, taken a long sectional line 4B-4B.

In the illustrated embodiment of FIGS. 4A-4B, the valve 30 is constructed of an elastomeric material, such as, for example, without limitation, rubber, silicon or a combination thereof. The lips 30*c* of the duckbill valve 30 are normally biased by the elastomeric material into sealing engagement with one another (FIG. 4B), i.e., a first constricted configuration. The duckbill valve 30 allows the flow of water through the lips 30*c* with positive differential pressure, i.e., greater pressure within the valve body 30*b* relative to externally to the valve 30. Thus, water poured into the valve assembly 26 flows to the lips 30*c*, overcomes the bias of the lips 30*c* and separates the lips 30*c* from one another, i.e., an expanded configuration, to, in turn, freely flow into the water reservoir 24. Conversely, backflow is substantially prevented by the duckbill valve 30 with negative differential pressure, i.e., greater pressure externally to the valve 30 relative to within the valve body 30*b*. Therefore, water within the water reservoir 24 cannot freely flow through the valve 30 out of the reservoir 24, regardless of the orientation of the iron 10 or the movement of the iron 10. Accordingly, the valve assembly 26 is a one-way valve assembly for only allowing entrance of water into the water reservoir 24.

Figure 5A:
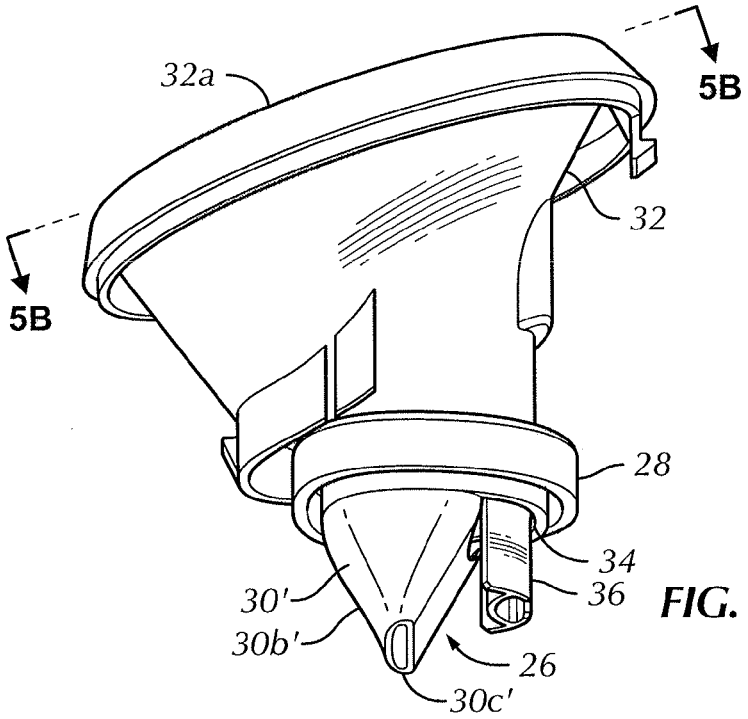
FIG. 5A is perspective side view of an alternative preferred embodiment of a one way check valve of the fill valve assembly of the present disclosure.
Figure 5B:
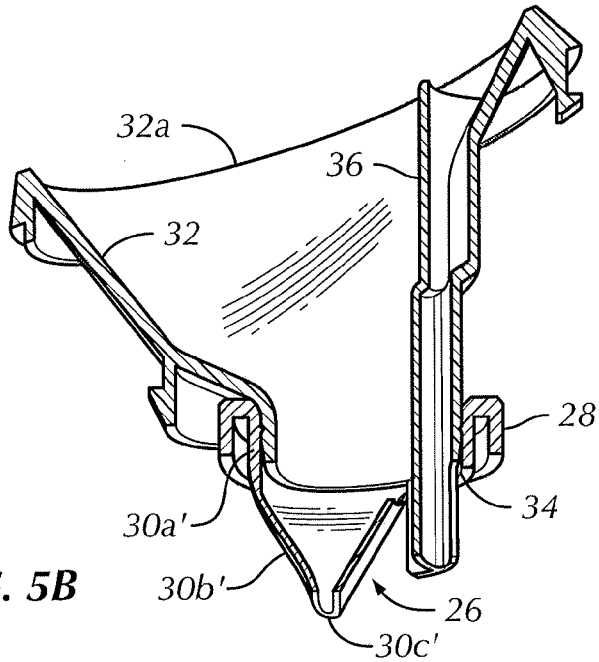
FIG. 5B is a cross-sectional perspective side view of the one way check valve of FIG. 5A, taken a long sectional line 5B-5B.

In an alternative embodiment, as shown in FIGS. 5A-5B, a valve body 30*b*' of a valve 30' projects from the first, open end 30*a*' of the valve 30' (from the upper rim 28) toward and into the upper end of the water reservoir 24, to an orifice 30*c*' defining an opposing second end of the valve 30'. The orifice 30*c*' is sufficiently small enough, in a first, i.e., initial, constricted configuration thereof (FIG. 5B), to substantially prevent water within the water reservoir 24 from freely exiting therethrough, regardless of the orientation of the iron 10 or the movement of the iron 10. In the first constricted configuration, the orifice 30*c*' preferably defines a diameter less than or equal to about 6 mm, and more preferably defines a diameter which is less than or equal to about 5 mm. In the illustrated embodiment, the orifice 30*c*' is generally semicircular in shape, and preferably defines a radius which is less than or equal to about 3 mm, and more preferably defines a radius which is less than or equal to about 2.5 mm. As should be understood by those of ordinary skill in the art, however, the orifice 30*c*' may take the form of different sizes and/or shapes (e.g., circular), as long as the orifice 30*c*' performs the functions described herein.

Similarly to the duckbill valve 30, the valve 30' is constructed of an elastomeric material, such as, for example, without limitation, rubber, silicon or a combination thereof. Thus, the orifice 30*c*' is expandable by water poured into the valve assembly 26, such that the poured-in water expands or opens the orifice 30*c*' to a greater size and substantially freely flows therethrough and into the water reservoir 24. The orifice 30*c*' elastically returns to the initial configuration thereafter.

In either embodiment of the valve 30, 30', the upper rim 28 further includes a small aperture 34 adjacent the open end 30*a*, 30*a*' of the valve 30, 30'. An exhaust tube 36, shaped correspondingly to the shape of the aperture 34, extends through the aperture 34 fluidly communicating the water reservoir 24 with an exterior of the iron 10, for exhausting air in the water reservoir 24, displaced by water filling the water reservoir, to the exterior.

The iron 10 further includes a funnel 32, sealingly engaged with the upper rim 28 and projecting out of the housing 12. The funnel 32 is in fluid communication with the valve assembly 26, for guiding water into the open end 30*a*, 30*a*' of the valve 30, 30'. In the illustrated embodiment, the funnel 32 is integral, i.e., monolithic, with the exhaust tube 36. The exhaust tube 36 extends from within the water reservoir 24 to approximately an upper end 32*a* of the funnel 32. However, as should be understood by those of ordinary skill in the art, the exhaust tube 36 may alternatively be a separately formed component from the funnel 32. Additionally, the exhaust tube 36 may alternatively extend entirely externally from the funnel 32.

In operation, a user pours water into the open end 32*a* of the funnel 32, which is led by the funnel 32 to the valve assembly 26. In the first embodiment, the flow of the poured-in water against the lips 30*c* separates the lips 30*c* and the water enters into the water reservoir 24. Thereafter, the lips 30*c* return to their normal sealing engaged position. Alternatively, in the second embodiment, the flow of the poured-in water expands and opens the orifice 30*c*', such that the poured-in water substantially freely flows therethrough and into the water reservoir 24. The orifice 30*c*' elastically returns to the initial constricted configuration thereafter.

Air within the water reservoir 24 that is displaced by the water entering into the reservoir 24 is exhausted to the exterior of the iron 10 via the exhaust tube 36. The user thereafter powers on the iron 10 to heat the sole plate 14. The user operates the iron, and the iron functions, in a conventional manner, well understood by those of ordinary skill in the art, such as, for example, as described in commonly owned U.S. patent application Ser. No. 14/208,499, filed on Mar. 13, 2014, entitled "Gravity-Fed Combined Iron and Steamer," which is hereby incorporated by reference in its entirety.

For example, the user selects the desired temperature by actuating the temperature control dial 20 and selects the desired flow of steam by actuating the steam control knob 21, and presses the iron 10 against a garment to be ironed. The user moves the iron 10 in a reciprocal back and forth motion over the garment to iron the garment. Advantageously, the water within the water reservoir 24 does not slosh or leak out of the reservoir 24, because the lips 30*c* of the duckbill valve 30 are biased into sealing engagement with one another, or the orifice 30*c*' of the valve 30' is sufficiently small in its normally constricted configuration, to substantially prevent the flow of water therethrough.

It will be appreciated by those skilled in the art that changes could be made to the embodiments described above without departing from the broad inventive concept thereof. It is understood, therefore, that this disclosure is not limited to the particular embodiments disclosed, but it is intended to cover modifications within the spirit and scope of the present disclosure as defined by the appended claims.

We claim:

1. An iron comprising:

a housing;

a sole plate on a base end of the housing;

a water reservoir within the housing for receiving water therein; and a water fill valve assembly in fluid communication with the water reservoir, the valve assembly including a one way check valve having an open first end, an opposing expandable second end proximate the water reservoir, and a valve body extending therebetween, the second end of the check valve normally being in a first constricted configuration, substantially preventing water within the water reservoir from freely exiting therethrough, the second end of the check valve being expandable by water poured into the open first end of the valve and flowing to the second end, such that the poured-in water substantially freely flows therethrough and into the water reservoir, the second end of the check valve returning to the first configuration after the poured in water has passed therethrough.

2. The iron of claim 1, wherein the check valve is a duckbill valve, a pair of lips defining the second end of the duckbill valve, the lips being biased into sealing engagement in the first constricted configuration, the poured-in water overcoming the bias of the lips and separating the lips from one another to freely flow into the water reservoir.

3. The iron of claim 1, wherein the second end of the check valve comprises an orifice of a size sufficiently small enough to substantially prevent water within the water reservoir from freely exiting therethrough and being expandable to a larger size by the poured-in water, to, in turn, flow through the expanded size orifice and into the water reservoir.

4. The iron of claim 3, wherein the orifice comprises a generally semicircular shape.

5. The iron of claim 3, wherein the orifice defines a diameter less than or equal to about 6 mm.

6. The iron of claim 1, wherein the check valve is constructed of an elastomeric material.

7. The iron of claim 6, wherein the elastomeric check valve is constructed of rubber.

8. The iron of claim 6, wherein the elastomeric check valve is constructed of silicone.

9. The iron of claim 1, wherein the valve assembly further comprises an upper rim, the open end of the check valve being engaged with the upper rim and the valve body projecting from the upper rim in a direction toward the water reservoir.

10. The iron of claim 9, wherein the upper rim further includes an aperture adjacent the open end of the check valve, and an exhaust tube extending through the aperture, the exhaust tube fluidly communicating the water reservoir with an exterior of the iron for exhausting air in the water reservoir displaced by water filling the water reservoir to the exterior.

11. The iron of claim 9, further comprising a funnel projecting outwardly from the housing and in fluid communication with the valve assembly, for guiding water toward the open end of the check valve.

12. An iron comprising:

a housing;

a sole plate on a base end of the housing;

a water reservoir within the housing, for receiving water therein; and a water fill valve assembly in fluid communication with the water reservoir, the valve assembly including an elastomeric duckbill valve having an open end, a pair of lips defining an opposing end thereof proximate the water reservoir, and a valve body extending therebetween, the lips being normally biased into sealing engagement with one another such that water within the water reservoir cannot freely flow through the valve assembly and wherein water poured into the open end of the valve assembly overcomes the bias of the lips and separates the lips from one another to freely flow into the water reservoir.

13. The iron of claim 12, wherein the elastomeric duckbill valve is constructed of rubber.

14. The iron of claim 12, wherein the elastomeric duckbill valve is constructed of silicone.

15. The iron of claim 12, wherein the valve assembly further comprises an upper rim, the open end of the duckbill valve being engaged with the upper rim and the valve body projecting from the upper rim in a direction toward the water reservoir.

16. The iron of claim 15, wherein the upper rim further includes an aperture adjacent the open end of the check valve, and an exhaust tube extending through the aperture, the exhaust tube fluidly communicating the water reservoir with an exterior of the iron for exhausting air in the water reservoir displaced by water filling the water reservoir to the exterior.

17. The iron of claim 1, further comprising a funnel projecting outwardly from the housing and in fluid communication with the valve assembly, for guiding water toward the open end of the check valve.

18. An iron comprising:

a housing;

a sole plate on a base end of the housing;

a water reservoir within the housing, for receiving water therein; and a water fill valve assembly in fluid communication with the water reservoir, the valve assembly including a check valve having an open end, a generally semicircular orifice defining an opposing end thereof proximate the water reservoir, and a valve body extending therebetween, the generally semicircular orifice having a radius of less than or equal to about 3 mm in an initial configuration to substantially prevent water within the water reservoir from freely exiting through the orifice, the orifice being expandable by water poured into the open first end of the valve and flowing to the orifice, such that the poured-in water substantially freely flows therethrough and into the water reservoir, the orifice of the check valve returning to the initial configuration after the poured in water has passed therethrough.

* * * * *